US005560781A

United States Patent [19]

Banks et al.

[11] Patent Number: 5,560,781

[45] Date of Patent: Oct. 1, 1996

[54] PROCESS FOR NON-CONTACT REMOVAL OF ORGANIC COATINGS FROM THE SURFACE OF PAINTINGS

[75] Inventors: Bruce A. Banks, Olmsted Township; Sharon K. Rutledge, Bedford, both of Ohio

[73] Assignee: The United States of America as represented by the Administrator of the National Aeronautics and Space Administration, Washington, D.C.

[21] Appl. No.: 439,544

[22] Filed: May 8, 1995

[51] Int. Cl.[6] ..... B08B 7/00

[52] U.S. Cl. ..... 134/1; 134/38

[58] Field of Search ..... 134/1, 1.1, 1.2, 134/38; 156/643.1, 646, 655, 667

[56] References Cited

U.S. PATENT DOCUMENTS

| | | | |
|---|---|---|---|
| 3,698,925 | 10/1972 | Salz et al. | 427/140 |
| 3,839,066 | 10/1974 | Brenner | 427/155 |
| 3,867,216 | 2/1975 | Jacob | 156/643.1 |
| 4,234,621 | 11/1980 | Fieux | 427/472 |
| 4,246,295 | 1/1981 | Crihan | 427/504 |
| 4,330,586 | 5/1982 | Fieux | 428/196 |
| 4,512,868 | 4/1985 | Fijimura et al. | 156/643.1 |
| 4,560,577 | 12/1985 | Mirtich et al. | 427/533 |
| 4,604,181 | 8/1986 | Mirtich et al. | 204/298.26 |
| 4,664,980 | 5/1987 | Sovey et al. | 428/421 |
| 4,699,689 | 10/1987 | Bersin | 156/643.1 |
| 4,717,806 | 1/1988 | Battey et al. | 156/345 |
| 4,775,789 | 10/1988 | Albridge, Jr. et al. | 250/251 |
| 4,828,817 | 5/1989 | Outlaw | 423/579 |
| 4,846,425 | 7/1989 | Champetier | 134/1 |
| 4,980,206 | 12/1990 | Torre et al. | 427/385.5 |
| 5,019,441 | 5/1991 | Zeliger | 428/196 |
| 5,236,672 | 8/1993 | Nunez et al. | 422/186.04 |
| 5,280,174 | 1/1994 | Banks et al. | 250/251 |

OTHER PUBLICATIONS

Banks et al., NASA Conference Publication 3035, pp. 197–239.

Atomic Oxygen Treatment for Non–Contact Removal of Organic Protective From Painting Surfaces (NASA Technical Memorandum 106650)—Sharon K. Rutledge, Bruce A. Banks, Michael Cales. Proceedings of Materials Issues in Art and Archaeology IV, Cancun, Mexico—May 16–20, 1994—Atomic Oxygen Treatment for Non–Contact Removal of Organic Protective Coatings from Painting Surfaces–Sharon K. Rutledge, Bruce A Banks, and Michael Cales–NASA Lewis Research Center, 21000 Brookpark Rd, Cleveland, OH 44135–Cleveland State University c/o NASA LeRC 21000 Brookpark Rd, Cleveland, OH 44135.

*Primary Examiner*—Lyle A. Alexander
*Assistant Examiner*—Alexander Markoff
*Attorney, Agent, or Firm*—Kent N. Stone; Susan D. Reinecke

[57] ABSTRACT

The present invention discloses a method of removing organic protective coatings from a painting. In the present invention degraded protective coatings such as lacquers, acrylics, natural resins, carbons, soot, and polyurethane are safely removed from the surface of a painting without contact to the surface of the painting. This method can be used for restoration of paintings when they have been damaged, through age, fire, etc.

17 Claims, 3 Drawing Sheets

PROCESS FOR NON-CONTACT REMOVAL OF ORGANIC COATINGS FROM THE SURFACE OF PAINTINGS

ORIGIN OF THE INVENTION

The invention described herein was made by employees of the United States Government and may be manufactured and used for the Government for governmental purposes without the payment of any royalties thereon or therefore.

FIELD OF THE INVENTION

The method disclosed in the instant application enables the removal of degraded organic coatings. In the present invention, degraded organic protective coatings such as lacquers, acrylics, natural resins, and polyurethane are safely removed without contact of the surface of the painting. The invention can remove all types of organic protective coatings uniformly over the surface without any surface structure altering physical contact. Low spots, as well as high spots on the painting surface, can be cleaned equally well. Polyurethane is easily removed by reacting with atomic oxygen without damage to the underlying painting.

DESCRIPTION OF RELATED ART

U.S. Pat. Nos. 5,019,441, 4,330,586; and 4,234,621 are processes for removal and rebinding of paintings. This involves the surface that the painted canvas s attached to which is the back of the painting and does not involve the removal of discolored organic coatings from the front painted surface. U.S. Pat. Nos. 4,246,295 and 3,698,925 involve the application of a protective coating to the surface of a painting which does not involve removal of discolored organic coatings from the surface. U.S. Pat. No. 3,698,925 involves the application of a coating to a painting surface which is water soluble and can be removed by dissolving, but the coating of the patent must be what is on the surface in order to remove it in this manner. U.S. Pat. No. 5,236,672 involves a process for removal of gaseous organic species from gas exhaust systems to enable meeting of the Clean Air Standard. This process does not involve removal of stable solid, organic surface coatings and does not discuss rastering techniques for uniform exposure.

SUMMARY OF THE INVENTION

This invention is directed to the combination of an atomic oxygen source, means for forming an atomic oxygen beam, and means for controlling the beam to remove a protective organic coating from the surface of a painting. In the specific embodiment of the invention a painting consisting of inorganic paints and a translucent protective organic layer is subjected to an atomic oxygen beam in a controlled manner which removes the protective coating without damaging the underlying paint. Previous techniques used to remove organic protective coatings typically consisted of immersion of the painting in organic solvents or rolling a swab containing the solvent over the surface of the painting.

There is no known solvent which will remove polyurethane without damaging the painting. For acrylic lacquer and natural resins, the current cleaning techniques allow contact of either a swab or liquid with the surface of the painting which alters the surface by removing pigment, smearing the pigment or altering the shape of the canvas surface. Swabbing is unable to remove lacquer effectively from the low spots on the paintings without damaging the adjoining pigment. Thus, restoration typically invites damage to the painting.

It is an object of the present invention to use an atomic oxygen plasma to remove organic protective coatings from paintings.

It is another object of the invention to use a directed beam of atomic oxygen to remove organic protective coatings from paintings.

It is a further object of the invention to use a directed beam of atomic oxygen which rapidly oxidizes surface organic protective coatings until inorganic pigment particles are exposed, which then greatly slows down the rate of oxidation of organic binder materials surrounding the pigment particles.

It is still yet another object of the present invention to use the differences between the fast rate of surface organic protective coatings removal and the subsequent slow rate of oxidation of the organic binder surrounding the pigment particles, thus allowing all the surface organic protective coating to be removed independent of its thickness and surface shape.

It is a further object of the invention to use a translating system to allow rastering of the atomic oxygen beam by moving the painting under the beam to enable uniform oxidation of the painting surface.

BRIEF DESCRIPTION OF THE DRAWINGS

The object advantages, and novel features of the invention will be more fully apparent from the following detailed description when read in connection with the accompanying drawings in which.

DESCRIPTION OF THE PREFERRED EMBODIMENT

In the preferred embodiment a painting is placed inside a vacuum chamber and exposed to an atomic oxygen directed beam generated by an electron cyclotron resonance plasma or other atomic oxygen beam source. The atomic oxygen chemically reacts with the organic protective coating, forming a gaseous byproduct which leaves the surface and is pumped out through the vacuum system. The atomic oxygen penetrates the organic protective coating until it comes into contact with the paint pigment particles, which are usually inorganic. The atomic oxygen does not react with the inorganic pigment, and the pigment acts as a shield to the binder layer underneath. The reaction slows as more pigment is exposed because the pigment consist of largely unreactive inorganic material. This continues until all of the organic protective coating is removed from the surface.

Figure 1:
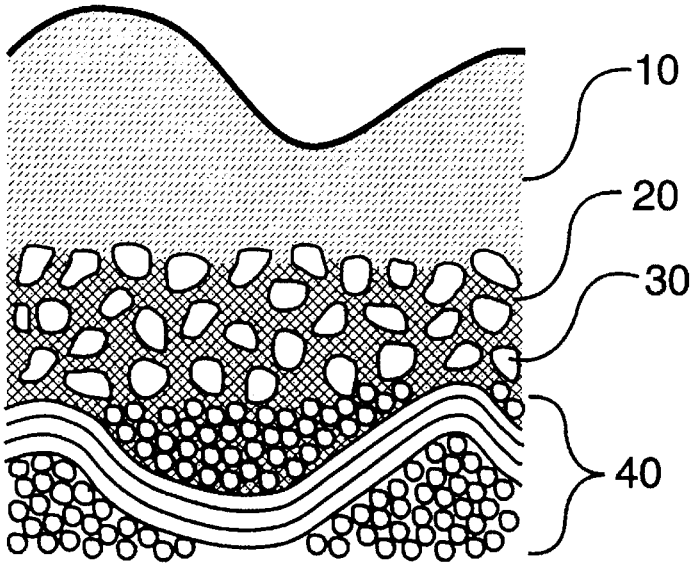
FIG. 1. displays a cross section of the painting prior to atomic oxygen beam treatment.
Figure 2:
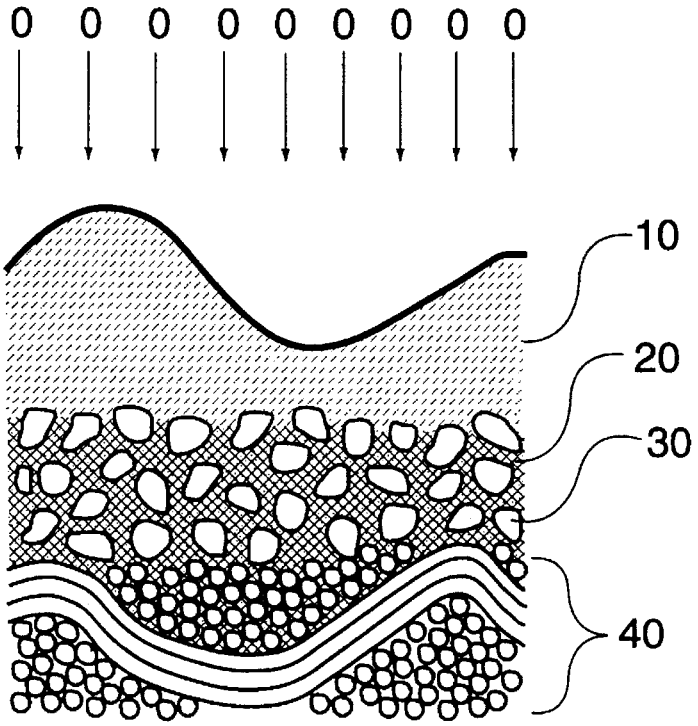
FIG. 2. displays the same painting as in FIG. 1. after a small amount of atomic oxygen exposure.
Figure 3:
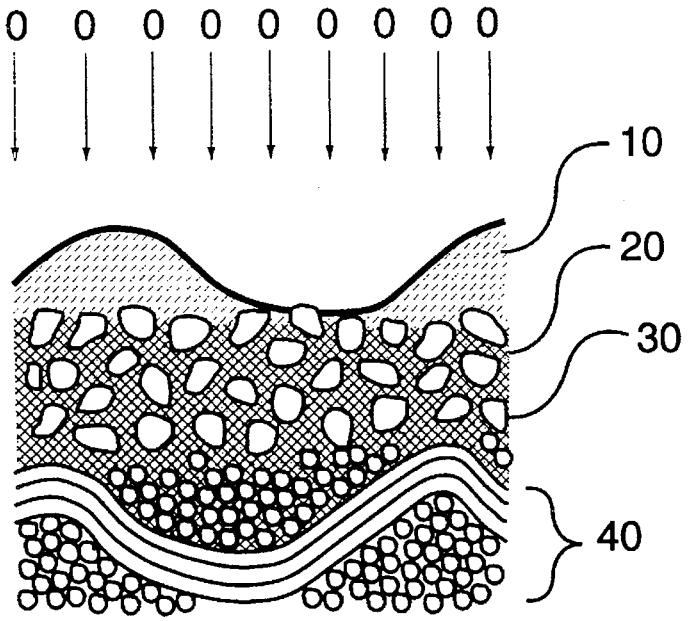
FIG. 3. displays the painting in FIG. 2 with the thinner areas of organic coating removed.
Figure 4:
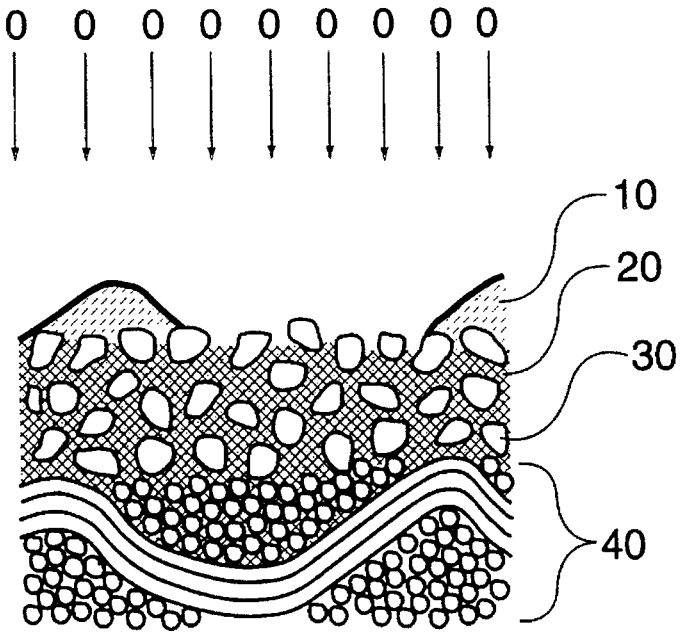
FIG. 4. displays the area in FIG. 3 after continued atomic oxygen bombardment.
Figure 5:
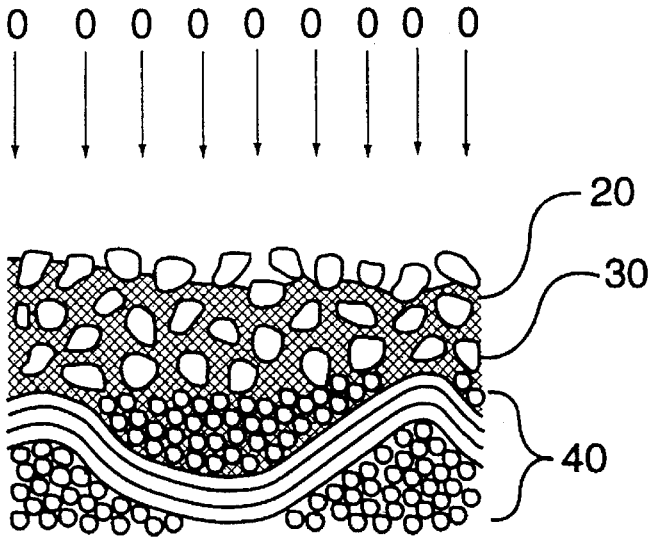
FIG. 5. displays a drawing in which oxidation of the protective coating is complete.
Figure 6:
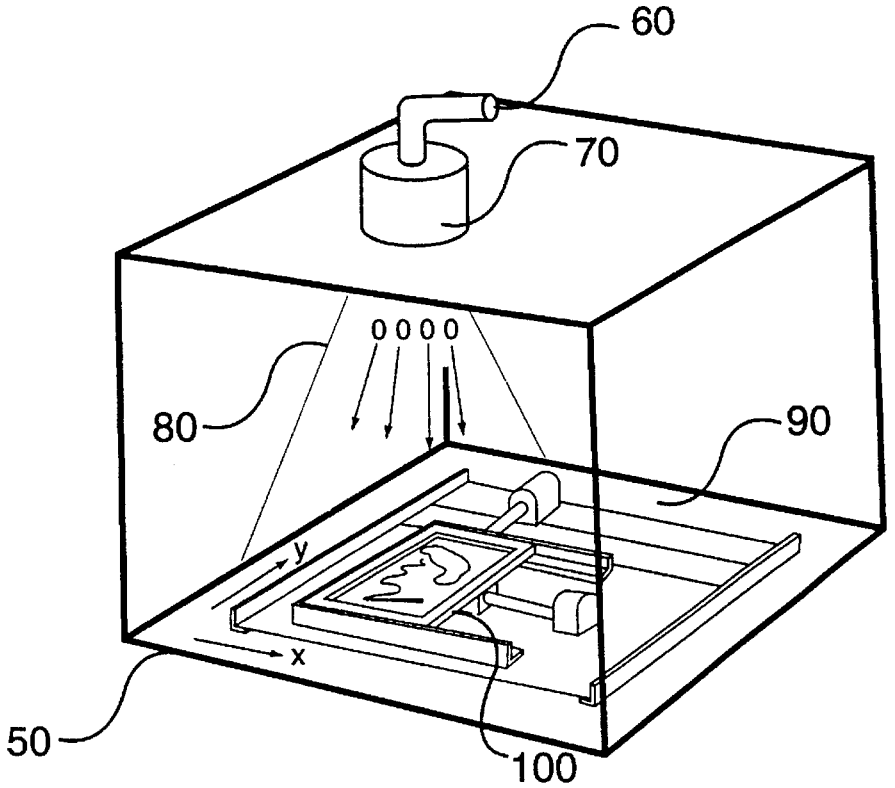
FIG. 6. displays the overall apparatus for performing the method disclosed in the instant application.

FIG. 1 shows a cross section of the painting prior to atomic oxygen beam treatment. In FIG. 1 inorganic paint pigment particles 30 intermixed with organic paint binders 20, rest on a canvas fabric 40. A layer of organic protective coating 10 rest on top of the mixture of inorganic paint pigment particles 30 and the organic paint binder 20. FIG. 2 shows the same painting location after a small amount of atomic oxygen exposure. In FIG. 3, the thinner areas of protective organic coating 10 have been removed, but the thicker areas have not. FIG. 4 shows the same region after further directed atomic oxygen bombardment. As can be seen from FIGS. 1 through 4 the inorganic paint pigment particles 30 prevent line-of-sight atomic oxygen attack of the organic matrix surrounding the pigment particles. This greatly slows down the oxidation of binder material, allowing time for all of the organic protective coating 10 to be oxidized without extensive loss of the pigment particles. When oxidation of the protective coating 10 is complete, as in FIG. 5, the painting can be removed from the vacuum and a fresh organic protective coating can then be applied. In FIG. 6 the apparatus utilized to perform the method disclosed in the instant application is displayed. In FIG. 6 a vacuum chamber 50 houses a painting 100 which is mounted on an x-y translation table 90. Oxygen 60 is pumped into an atomic oxygen beam source 70 to form a atomic oxygen beam 80. If the painting is larger than the size of the beam area, it is moved slowly under the atomic oxygen beam source to enable the beam to effectively raster over the painting to treat the entire surface uniformly, as shown in FIG. 6.

Alternate Embodiments of the Invention

The source of atomic oxygen can be a thermal plasma generated by RF, microwave, or DC discharges of air, oxygen, or a mixture of oxygen with inert gases. The atomic oxygen can be produced using multiple sources operated simultaneously or using a single source with movement of the painting underneath in a rastering pattern with a vacuum compatible translation system.

The method disclosed in the present invention can also be used to remove contaminants from the surface of a painting resulting from a fire. These contaminants include carbon soot and other hydrocarbons.

While several embodiments of the invention are disclosed and described it will be apparent that various modifications may be made without departing from the scope of the invention or the scope of the subjoined claims.

What is claimed:

1. A method of removing an organic coating from a painting, wherein said painting comprises substrate containing inorganic pigments on the surface of said substrate which act as a shield to a binder layer under said pigments, comprises the steps of:

reacting said organic coating with atomic oxygen thereby forming a gaseous byproduct which leaves said surface, and continuing said reacting until said substrate surface is exposed and said inorganic pigments are undisturbed.

2. A method as claimed in claim 1 wherein said reacting is done in a vacuum environment.

3. A method as claimed in claim 2 wherein the organic coating is a material selected from the group consisting of lacquers, acrylics, natural resins, hydrocarbons, carbon, soot and polyurethanes.

4. A method as claimed in claim 3 wherein the atomic oxygen is in the form of at least one directed beam from at least one source.

5. A method as claimed in claim 4 wherein the beam source is an electron cyclotron resonance plasma.

6. A method as claimed in claim 4 wherein the beam source is a thermal plasma.

7. A method as claimed in claim 6 wherein the thermal plasma is generated by discharges selected from the group consisting essentially of radio frequency microwave, and direct current.

8. A method as claimed in claim 7 wherein the discharges are of air, oxygen, or a mixture of oxygen with inert gases.

9. A method as claimed in claim 4 wherein the atomic oxygen beam is from a single source and the painting is moved relative to said beam in a rastering pattern.

10. A method as claimed in claim 4 where the atomic oxygen is in the form of a plurality of beams produced by multiple sources operated simultaneously.

11. A method as claimed in claim 4 wherein the gaseous byproduct is pumped from the vacuum environment.

12. A method of removing an organic material from a painting, wherein said painting comprises a substrate containing inorganic pigments on the surface of said substrate which act as a shield to a binder layer under said pigments, comprising the steps of placing said painting in a vacuum environment, exposing said surface to a beam of atomic oxygen which said surface is in said vacuum environment whereby said atomic oxygen chemically reacts with said organic material thereby forming a gaseous byproduct which leaves said surface, and removing said byproduct from said vacuum environment while continuing to expose said surface to said beam until said beam contacts said substrate which does not chemically react with said atomic oxygen.

13. A method as claimed in claim 12 where the organic material is selected from the group consisting essentially of lacquers, acrylics, natural resins, carbon, soot, and polyurethanes.

14. A method as claimed in claim 13 wherein the atomic oxygen beam is generated by an atomic oxygen source selected from the group consisting of an electron cyclotron resonance plasma, and a thermal plasma.

15. A method as claimed in claim 14 wherein the thermal plasma is generated by discharges selected from radio frequency, microwave, and direct current.

16. A method as claimed in claim 15 wherein the discharges are of air, oxygen, or a mixture of oxygen with inert gases.

17. A method as claimed in claim 16 wherein the atomic oxygen is in the form of a beam from a single source and the painting is moved relative thereto in a rastering pattern in said vacuum environment.

* * * * *